US007025127B2

(12) United States Patent
Wu et al.

(10) Patent No.: US 7,025,127 B2
(45) Date of Patent: Apr. 11, 2006

(54) BAFFLED SURFACE COOLED HEAT EXCHANGER

(75) Inventors: Alan Wu, Kitchener (CA); Michael Martin, Oakville (CA); Kenneth M. A. Abels, Oakville (CA); Robert Hance Brown, Elmvale (CA)

(73) Assignee: Dana Canada Corporation, Oakville (CA)

( * ) Notice: Subject to any disclaimer, the term of this patent is extended or adjusted under 35 U.S.C. 154(b) by 206 days.

(21) Appl. No.: 10/612,434

(22) Filed: Jul. 2, 2003

(65) Prior Publication Data

US 2004/0069474 A1 Apr. 15, 2004

(30) Foreign Application Priority Data

Jul. 5, 2002 (CA) ..... 2392610

(51) Int. Cl.
*F28F 3/12* (2006.01)

(52) U.S. Cl. ..... 165/170; 165/80.4; 165/168

(58) Field of Classification Search ..... 165/80.4, 165/168, 170
See application file for complete search history.

(56) References Cited

U.S. PATENT DOCUMENTS

| | | | | |
|---|---|---|---|---|
| 1,049,695 | A * | 1/1913 | Garrison | 237/12.3 A |
| 1,318,875 | A * | 10/1919 | Hutchinson | 165/170 |
| 1,775,819 | A * | 9/1930 | Fischer et al. | 165/170 |
| 1,996,622 | A | 4/1935 | Lambert | |
| 2,039,593 | A | 5/1936 | Hubbuch et al. | |
| 2,154,216 | A * | 4/1939 | Savage | 165/170 |
| 2,547,668 | A | 4/1951 | Simpelaar | |
| 2,582,358 | A | 1/1952 | Schoellerman | |
| 2,796,239 | A | 6/1957 | Holmes et al. | |
| 2,814,470 | A | 11/1957 | Peterson | |

(Continued)

FOREIGN PATENT DOCUMENTS

| | | |
|---|---|---|
| CH | 220299 | 3/1942 |

(Continued)

OTHER PUBLICATIONS

Fuel Cooling Needs for Advanced Diesel Engines by Michael Davies, John Burgers and Nick Kalman in SAE Technical Paper Series, May 19-22, 1997.

*Primary Examiner*—Allen J. Flanigan
(74) *Attorney, Agent, or Firm*—Ridout & Maybee LLP

(57) ABSTRACT

Surface cooled heat exchanger that includes a substantially planar shim plate with spaced apart integral first and second end walls extending laterally therefrom, and a separately formed cover plate having a central wall with integral first and second side walls extending from opposite sides of the central wall portion. The first and second side walls of the cover plate are sealably joined to respective side edges of the shim plate, the first and second end walls are sealably joined to respective ends of the cover plate. The central wall portion and shim plate are spaced apart with an internal fluid passage being defined therebetween with inlet and outlet openings provided in flow communication with the fluid passage to allow fluid to flow into, through, and out of the fluid passage. Includes a fin plate having a planar support wall with a first side abutting against and secured to the shim plate and an opposite facing second side along which a plurality of exposed cooling fins are provided. The end walls are each preferably formed from portions that have been partially cut from the planar shim plate and folded about a fold line to extend substantially perpendicular to the shim plate. Flow circuiting baffle plates may similarly be provided in the fluid passage.

19 Claims, 5 Drawing Sheets

U.S. PATENT DOCUMENTS

| | | | | |
|---|---|---|---|---|
| 2,981,520 | A | | 4/1961 | Chadburn |
| 2,985,434 | A | | 5/1961 | Bering et al. |
| 3,024,003 | A | | 3/1962 | Speca et al. |
| 3,141,500 | A | | 7/1964 | Raskin |
| 3,147,800 | A | | 9/1964 | Tadewald |
| 3,650,310 | A | | 3/1972 | Childress |
| 3,800,868 | A | * | 4/1974 | Berkowitz et al. ..... 165/170 |
| 3,818,984 | A | | 6/1974 | Nakamura et al. |
| 4,002,200 | A | * | 1/1977 | Raskin ..... 165/131 |
| 4,072,188 | A | | 2/1978 | Wilson et al. |
| 4,085,728 | A | * | 4/1978 | Tomchak ..... 126/669 |
| 4,134,195 | A | | 1/1979 | Jacobsen et al. |
| 4,361,184 | A | | 11/1982 | Bengtsson |
| 4,478,277 | A | | 10/1984 | Friedman et al. |
| 4,574,876 | A | | 3/1986 | Aid |
| 4,615,129 | A | | 10/1986 | Jackson |
| 4,646,815 | A | | 3/1987 | Iwata |
| 5,009,557 | A | | 4/1991 | Dessirier |
| 5,028,989 | A | | 7/1991 | Naganuma et al. |
| 5,099,311 | A | | 3/1992 | Bonde et al. |
| 5,129,473 | A | | 7/1992 | Boyer |
| 5,152,255 | A | | 10/1992 | Fukuda |
| 5,159,529 | A | | 10/1992 | Lovgren et al. |
| 5,174,258 | A | | 12/1992 | Tanaka |
| 5,205,348 | A | | 4/1993 | Tousignant et al. |
| 5,228,511 | A | | 7/1993 | Boquel et al. |
| 5,232,066 | A | | 8/1993 | Schnelker |
| 5,251,718 | A | | 10/1993 | Inagawa |
| 5,273,386 | A | | 12/1993 | Luhm |
| 5,285,347 | A | | 2/1994 | Fox et al. |
| 5,316,077 | A | | 5/1994 | Reichard |
| 5,327,957 | A | | 7/1994 | Killebrew |
| 5,381,510 | A | | 1/1995 | Ford et al. |
| 5,423,376 | A | | 6/1995 | Julien et al. |
| 5,490,559 | A | | 2/1996 | Dinulescu |
| 5,495,889 | A | | 3/1996 | Dubelloy |
| 5,517,757 | A | | 5/1996 | Hayashi et al. |
| 5,586,614 | A | | 12/1996 | Kouchi et al. |
| 5,787,613 | A | | 8/1998 | Derome |
| 5,829,517 | A | | 11/1998 | Schmid et al. |
| 5,884,588 | A | | 3/1999 | Ap |
| 5,901,037 | A | | 5/1999 | Hamilton et al. |
| 5,918,664 | A | | 7/1999 | Torigoe |
| 5,934,364 | A | | 8/1999 | Chrysler et al. |
| 5,957,230 | A | | 9/1999 | Harano et al. |
| 5,979,542 | A | | 11/1999 | Inoue |
| 5,984,000 | A | | 11/1999 | Nakamura et al. |
| 5,992,552 | A | | 11/1999 | Eto |
| 6,098,706 | A | | 8/2000 | Urch |
| 6,109,217 | A | | 8/2000 | Hedlund et al. |
| 6,227,290 | B1 | | 5/2001 | Nishishita et al. |
| 6,241,011 | B1 | | 6/2001 | Nakamura et al. |
| 6,293,338 | B1 | | 9/2001 | Chapman et al. |
| 6,305,463 | B1 | | 10/2001 | Salmonson |
| 6,340,053 | B1 | | 1/2002 | Wu et al. |
| 6,438,840 | B1 | | 8/2002 | Tavi et al. |
| 6,536,516 | B1 | | 3/2003 | Davies |
| 6,729,389 | B1 | * | 5/2004 | Ohashi ..... 165/168 |
| 6,843,512 | B1 | | 1/2005 | Fritze et al. |
| 2003/0164233 | A1 | | 9/2003 | Wu et al. |
| 2003/0173068 | A1 | | 9/2003 | Davies et al. |
| 2004/0238162 | A1 | | 12/2004 | Seiler et al. |
| 2005/0115700 | A1 | | 6/2005 | Martin et al. |
| 2005/0115701 | A1 | | 6/2005 | Martin et al. |

FOREIGN PATENT DOCUMENTS

| | | |
|---|---|---|
| DE | OS 2 201 559 | 7/1973 |
| DE | 33 28 229 | 10/1985 |
| DE | 297 15 828 U1 | 12/1997 |
| DE | 297 22 841 U | 2/1998 |
| DE | 298 03 166 U | 5/1998 |
| DE | 202 07 168 | 9/2002 |
| EP | 0805328 | 11/1997 |
| EP | 0807756 | 11/1997 |
| EP | 0826874 | 3/1998 |
| EP | 0890810 | 1/1999 |
| EP | 0907061 | 4/1999 |
| FR | 1189606 | 10/1959 |
| FR | 1534246 | 7/1968 |
| FR | 2748800 | 11/1997 |
| FR | 2769082 | 4/1999 |
| FR | 2772838 | 6/1999 |
| FR | 2774462 | 8/1999 |
| FR | 2774463 | 8/1999 |
| FR | 2774635 | 8/1999 |
| FR | 2778973 | 11/1999 |
| FR | 2785377 | 5/2000 |
| GB | 259824 | 10/1926 |
| GB | 766331 | 1/1957 |
| GB | 2277781 | 11/1994 |
| JP | 61-66061 | 4/1986 |
| JP | 62 009182 | 1/1987 |
| JP | 7-280484 | 10/1995 |
| WO | WO 94/23257 A1 | 10/1994 |
| WO | WO 94/23449 | 10/1994 |
| WO | WO 01/25711 | 4/2001 |
| WO | WO 03/059598 | 7/2003 |
| WO | WO 03/071213 A1 | 8/2003 |

* cited by examiner

BAFFLED SURFACE COOLED HEAT EXCHANGER

This application claims priority to Canadian Patent Application No. 2,392,610 filed Jul. 5, 2002.

BACKGROUND OF THE INVENTION

The present invention relates to surface cooled heat exchangers used for cooling fluid.

Surface cooled heat exchangers are often used in applications where the height clearance for a heat exchanger is quite low, for example, slush box engine coolant coolers in snowmobiles, and under-body mounted fuel coolers in automotive applications. One style of known surface cooled heat exchangers are extrusion formed devices that include fins integrally extruded with top and bottom walls that are connected along opposite sides to define a cavity that is welded shut at opposite ends after extrusion to provide a fluid cooling container. An example of such a heat exchanger for use as a rear cooler on a snowmobile can be seen in U.S. Pat. No. 6,109,217 issued Aug. 29, 2000. In extrusion formed coolers, the extrusion process makes it difficult to include fluid circuiting baffles or turbulizers within the cavity.

Known low profile surface cooled heat exchangers can be heavy and can be relatively expensive to manufacture. Thus, there is a need for a surface cooled heat exchanger that is relatively light-weight and relatively cost efficient to manufacture. Also desired is a surface cooled heat exchanger that can be manufactured in a range of sizes with little tooling changes, and in which flow circuiting can be easily incorporated.

SUMMARY OF THE INVENTION

According to one aspect of the present invention, there is provided a surface cooled heat exchanger that includes a substantially planar shim plate with spaced apart integral first and second end walls extending laterally therefrom, and a separately formed cover plate having a central wall with integral first and second side walls extending from opposite sides of the central wall portion. The first and second side walls of the cover plate are sealably joined to respective side edges of the shim plate, the first and second end walls are sealably joined to respective ends of the cover plate. The central wall portion and shim plate are spaced apart with an internal fluid passage being defined therebetween with inlet and outlet openings provided in flow communication with the fluid passage to allow fluid to flow into, through, and out of the fluid passage. The heat exchanger preferably includes a fin plate having a planar support wall with a first side abutting against and secured to the shim plate and an opposite facing second side along which a plurality of exposed cooling fins are provided. The end walls are each preferably formed from portions that have been partially cut from the planar shim plate and folded about a fold line to extend substantially perpendicular to the shim plate. Flow circuiting baffle plates may similarly be provided in the fluid passage.

BRIEF DESCRIPTION OF THE DRAWINGS

Preferred embodiments of the present invention will be described, by way of example with reference to the following drawings.

DESCRIPTION OF THE PREFERRED EMBODIMENTS

Figure 1:
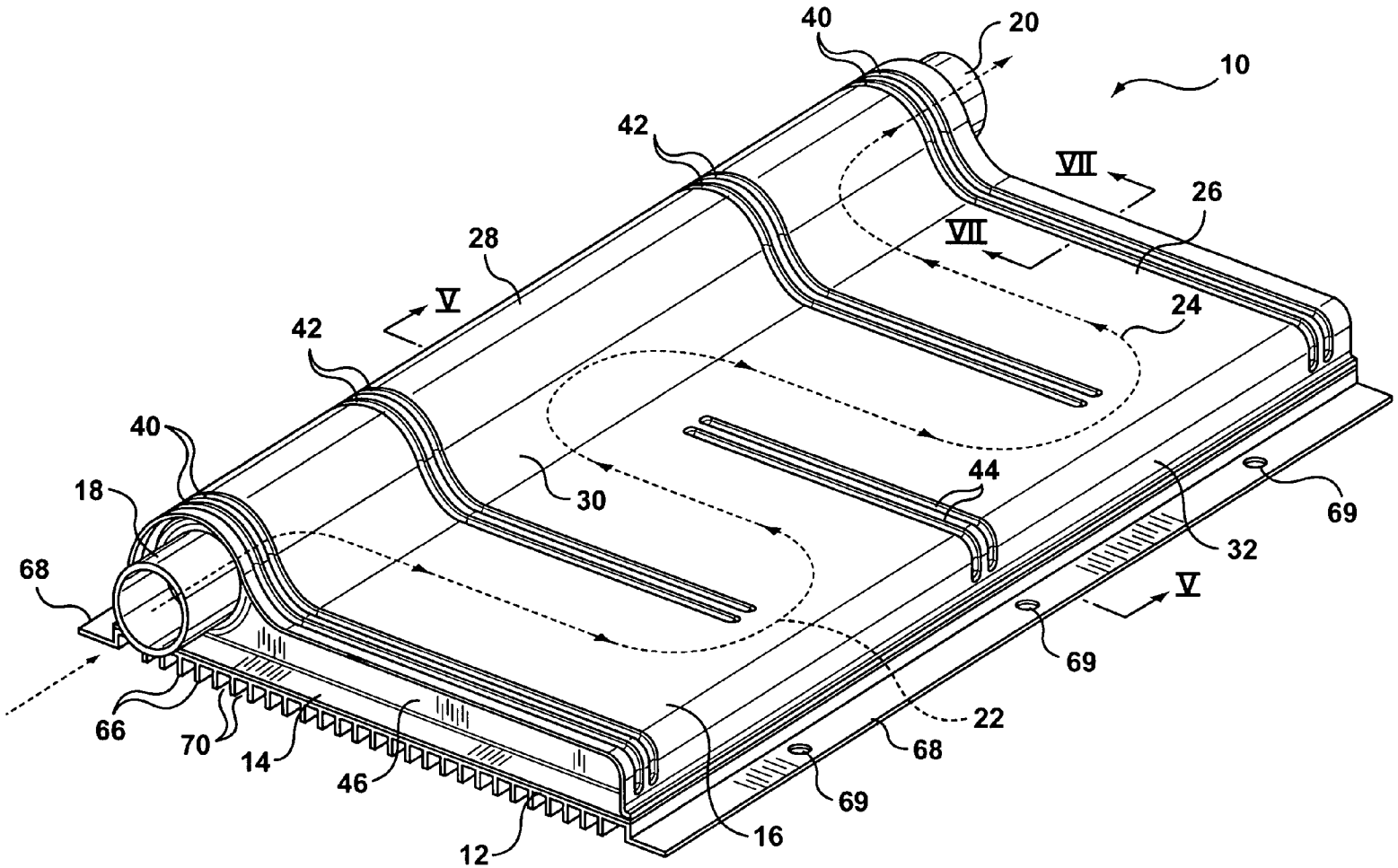
FIG. 1 is a perspective view of a heat exchanger according to an embodiment of the invention.
Figure 2:
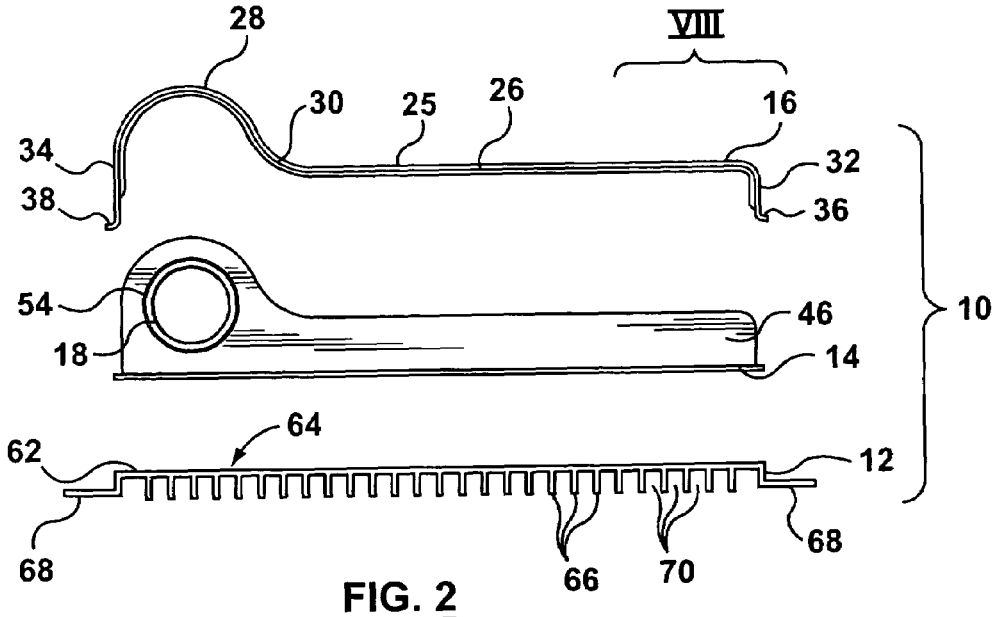
FIG. 2 is an exploded end view of the heat exchanger of FIG. 1.

With reference to FIGS. 1 and 2, there is shown perspective and exploded end views of a heat exchanger, indicated generally by reference numeral 10, according to a preferred embodiment of the invention. The heat exchanger 10 includes a bottom fin plate 12, a shim plate 14, a cover plate 16, and inlet and outlet fittings 18, 20. Orientational terms such as "bottom", "top", and "vertical" are used in this description for the purposes of explanation only. The heat exchanger can have any orientation desired.

The cover plate 16 and the shim plate 14 define a generally flat, low profile fluid container having a baffled internal fluid passage 22 that is in communication with inlet and outlet fittings 18, 20, such that a fluid can flow through the heat exchanger fluid passage 22 in a serpentine pattern as indicated by dashed line 24.

The cover plate 16 is of unitary construction and, in a preferred embodiment is made of stamped aluminum or aluminum alloy sheet that is braze clad, although other suitable materials could be used in place of braze clad aluminum, and other forming methods such as roll-forming could be used. The cover plate 16 is open-ended and has a top wall 25 that is made up of a generally rectangular planar portion 26 and an outwardly projecting semi-cylindrical manifold portion 28. The planar portion 26 and semi-cylindrical portion 28 are integrally joined by a curved wall portion 30. A first side wall 32 is provided along one peripheral side edge of the top wall 25, and an opposing second side wall 34 is provided along the opposite side edge of the top wall 25. Outwardly extending flanges 36 and 38 are provided along the bottom edges of the side walls 32,34, respectively, for abutting against corresponding peripheral edge portions of the shim plate 14. As will be explained in greater detail below, sets of parallel ribs 40, 42 and 44 are preferably provided along the top wall for engaging and supporting baffle and end wall portions of the shim plate 14.

Figure 3:
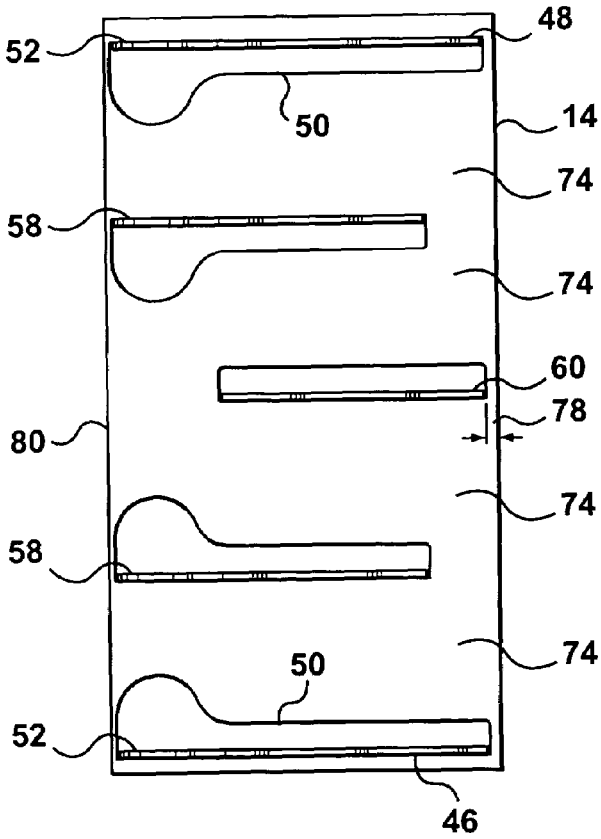
FIG. 3 is a top view of a shim plate of the heat exchanger of FIG. 1.
Figure 4:
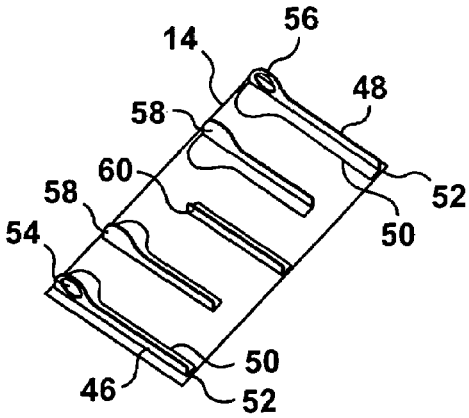
FIG. 4 is a perspective view of the shim plate.

With reference to FIGS. 2, 3 and 4, the shim plate 14 is of unitary construction and, in a preferred embodiment is made of die cut aluminum or aluminum alloy sheet that is braze clad, although other suitable materials could be used in place of braze clad aluminium, and other forming methods such as laser cutting could be used. The shim plate 14 is a flat, substantially rectangular plate having a first planar side that faces an inner side of the top wall 25 of the cover plate 16, and an opposite planar side that abuts against and is connected to the fin plate 12. The shim plate 14 includes vertically extending end walls 46 and 48 at opposite ends thereof for engaging the top wall 25 of the cover plate. The end walls 46 are formed by cutting end wall shapes along respective lines 50 in the shim plate 14, and the folding the end walls up along respective fold lines 52. A fluid inlet opening 54 is provided through the first end wall 46 for receiving inlet fitting 18, and a fluid outlet opening 56 is provided through the second end wall 48 for receiving outlet fitting 20. Intermediate vertical baffle walls 58 and 60 are also preferably provided on the shim plate between the end walls for circuiting fluid in a non-direct path through the fluid passage 22 of the heat exchanger 10 between the fluid inlet and fluid outlet. As with the end walls 46 and 48, the baffle walls 58 and 60 are also formed from the shim plate material using a cut and fold process. Planer horizontal peripheral edge portions 78, 80 extend along each of the elongate sides of the shim plate 14 to provide bonding surfaces for the flanges 36 and 38, respectively.

Referring to FIGS. 1 and 2, the fin plate 12 is in one preferred embodiment, a unitary structure formed from extruded aluminum or aluminum alloy that will, in many applications, not be braze clad. The fin plate 12 includes a flat support wall 62 having a first planar side 64 facing and secured to the shim plate 14, and an opposite facing side on which is provided a plurality of elongate, parallel fins 66. Portions of the first planar side 64 located under the folded up parts of the shim plate are directly exposed to the fluid passage 22. Mounting flanges 68 having securing openings 69 therethrough may be provided along opposite side edges of the support wall 62 to allow the heat exchanger to be mounted by brackets to a surface. In one preferred embodiment, the fins 66 each run substantially from a first end to a second end of the support wall 62, and define a plurality of elongate passages 70 therebetween. However, the fin configuration is not essential, and other alternative fin structures could be used in embodiments of the present invention. The side of the fin plate 12 facing away from the shim plate 14 is open such that alternating fins 66 and passages 70 are exposed to substances such as snow, ice and water that may be thrown against the exposed fins and passages by a snowmobile tread. In the illustrated embodiment the fins 66 are straight fins, that each extend a uniform distance at a perpendicular angle from the lower planar side of the fin support wall 62, and which run from one end to an opposite end of the heat exchanger. Other suitable fin plate configurations could of course be used in the present invention. In some embodiments, a support wall 62 with no extending fins may be used, or other structures such as outwardly extending dimples or ribs could be provided on the bottom of the support wall 62 instead of fins. In some embodiments, the fin plate 12 may be omitted entirely, with the shim plate 14 being the bottom of the heat exchanger (in such embodiments, end walls and baffle walls will generally be formed by some means other than cutting and folding portions of the shim plate 14).

Figure 5:
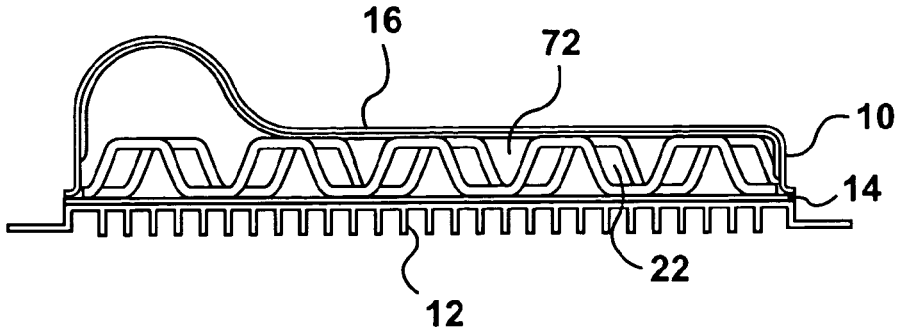
FIG. 5 is a sectional view taken across the lines V—V of FIG. 1.
Figure 6:
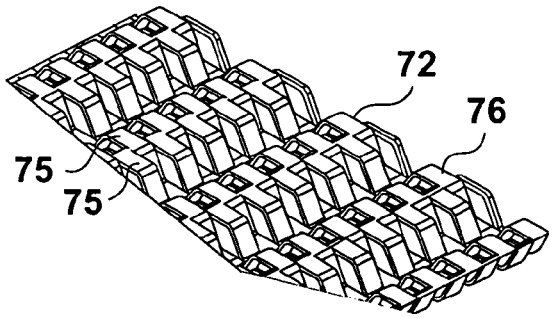
FIG. 6 is a perspective view of part of a turbulizer used in the heat exchanger of FIG. 1.

A turbulizer is preferably provided in the fluid passage 22 in the spaces 74 (see FIG. 3) between the baffle walls and end walls in order to augment and enhance the flow of fluid through the heat exchanger, provide increased heat exchange efficiency, and add strength to the heat exchanger structure. The sectional view of FIG. 5 shows a turbulizer 72 located in fluid passage 22. With reference to FIG. 6, in a preferred embodiment, the turbulizer 72 is formed of expanded metal, namely aluminum, either by roll forming or a stamping operation. Staggered or offset transverse rows of convolutions 75 are provided on turbulizer 72. The convolutions have flat bottoms and tops 76 to provide good bonds with cover plate 16 and shim plate 14, although they could have round tops, or be in a sine wave configuration, if desired. The turbulizer 72 may be a single sheet having a rectangular profile similar to but slightly smaller than that of the shim plate, with slotted sections to accommodate the ribs 58 and 60, or alternatively, a number of smaller turbulizers could be used, each one located in a corresponding space 74.

The heat exchanger 10 is constructed by assembling the parts in the order shown in FIGS. 1, 2 and 5, clamping the parts together, and applying heat to the assembled components in a brazing oven. The cover plate side wall flanges 36,38 are sealably brazed to the shim plate edges 78,80, and the top edges of each of the end plates 46, 48 and baffle plates 58, 60 are sealably brazed to the cover plate 16. The turbulizer 72 is sandwiched between and brazed to the cover plate 16 and shim plate 14, and the shim plate 14 brazed to the support wall 62 of the fin plate 12. Fittings 18 and 20 are brazed within respective inlet and outlet openings 54 and 56.

Figure 7:
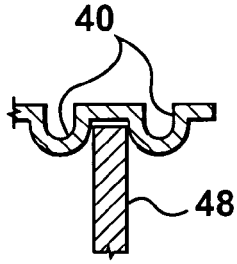
FIG. 7 is a partial sectional view taken across the lines VII—VII of FIG 1.

As mentioned above, parallel rib sets 40 are provided near both ends of the cover plate 16 for receiving the end walls 46, 48. In this regard, FIG. 7 shows a partial sectional view of an upper edge portion of end wall 48 received between the parallel rib set 40 located at one end of the cover plate 16. The rib sets 40 each extend transversely across the width of the top wall 25 of the cover plate 16, and down the first side wall 32 and the second side wall 34 such that substantially the entire cut edge of each end plate 46, 48 is received between a rib set. The ribs sets 42 and 40 engage the edges of the baffle plates 58,60 in a similar manner as is shown in FIG. 7. The parallel rib sets 40, 42 and 44 provide improved edge brazing and stronger joints between the end and baffle plates and the cover plate. Parallel rib sets may not be required in some heat exchanger applications, and in some embodiments, a single rib may be used in place of a rib pair, with the baffle or end plate edge abutting against and brazed to the single rib.

In addition to providing end and baffle walls, the shim plate provides a larger bonding surface for securing the cover plate to the bare aluminium fin plate (as opposed to a configuration in which a shim plate is not present). In the presently described embodiment, the flat end walls 46 and 48 provide a flat surface for brazing of inlet and outlet fittings 18, 20, which are located opposite each other. Locating the inlet and outlet fittings 18, 20 at the ends of the heat exchanger such that fluid can flow into and out of the heat exchanger in the same general flow direction that fluid flows through the heat exchanger can offer a less restricted flow than top mounted fittings, producing a lower pressure drop and wasting less energy. Top mounted fittings that introduce and remove fluid in a flow direction that is perpendicular to the shim plate can provide restricted flow due the limited space between the cover plate and the shim plate in low profile coolers. Top mounted fittings, may, however, be acceptable in some applications.

The raised cover plate portion provided by semi-cylindrical wall portion 28 provides for larger diameter fittings 18, 20 to be used to accommodate high flow rates. The raised portion also serves as a manifold to help distribute fluid around the fluid passage 22 and can provide a larger cross-sectional area for fluid to pass from section to section (as separated by baffle walls) of the fluid passage 22. The raised portion can allow longer baffle walls to be used in the heat exchanger without restricting fluid flow, allowing for better use of the support wall 62 of the fin plate 12 for heat transfer.

Figure 8:
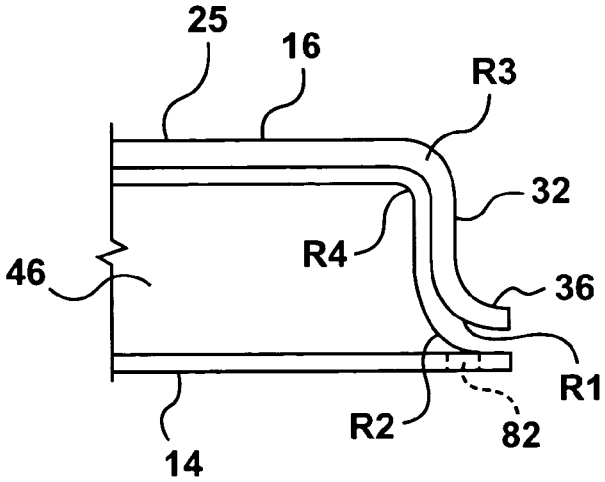
FIG. 8 shows a partial exploded end view of a portion of the heat exchanger indicated by numeral VIII of FIG. 2.

Preferably, the corners of the end plates 46 and 48 and the baffle plates 58 and 60 are profiled to conform to corresponding corners of the cover plate 16 to assist in providing improved corner braze joints. By way of example, FIG. 8 shows a partial exploded end view of portions of the cover plate 16 and shim plate 14 indicated by numeral VIII of FIG. 2. As can be appreciated from FIG. 8, when the cover plate 16 is folded to form side wall 32 and flange 36, the fold lines between the top wall 25 and side wall 32 and between side wall 32 and flange 36 will typically not be perfect right angles but will rather have a some degree of curvature at corners R3 and R1. In order to provide a tight fit between end wall 46 and the cover plate 16, the end plate is preferably cut so that its corners R2 and R4 are profiled to conform to corners R1 and R3, respectively, of the cover plate 16 when the two plates are bonded together. In some embodiments, such profiling may require making the curvature of the corners on the shim plate slightly different than the corners on the cover plate. For example, in one embodiment, the radius of curvature of corner R2 may be greater than that of corner R1. Small holes through the shim plate 14, as indicated in phantom by reference 82 in FIG. 8, may be used in some embodiments at the ends of the fold lines for the end and baffle plates to facilitate clean folding of such plates.

Soldering, welding, or induction methods could, in some applications, be used in place of brazing for connecting the components of heat exchanger 10 together. Other metallic materials, for example steel or stainless steel, and non-metallic polymer materials could be used to form some or all of the components of the heat exchanger for some embodiments. Polymer components could be thermally bonded together, ultrasonically bonded, or bonded using adhesive or other means.

The heat exchanger 10 can conveniently be used as a low-profile device for cooling a fluid that passes through the fluid flow container defined by the cover plate 16 and shim plate 14, with heat from fluid being conducted away from the fluid to exposed fins 66, which in turn are cooled by, in the case of a snowmobile cooler, snow, water, air and ice. The heat exchanger can also be used, for example, as an underbody mounted fuel cooler in an automotive application, with cooling being facilitated by air passing over exposed fins 66, although these examples are not exhaustive.

The heat exchanger 10 can be manufactured in different sizes relatively easily by extruding longer fin plates 12 and forming correspondingly longer shim and cover plates 14,16. Baffle and end plates that are cut and folded from shim plate 14 can be configured so that the same tool can be used for all baffle and end plates. The end-to-end nature of semi-cylindrical portion 28 of top wall 25 of the cover plate 16 makes the cover plate easy to form in different lengths with minor tooling adjustments. In some embodiments, however, the top wall 25 may be flat across its entire width, or the semi-cylindrical portion may not extend the entire length of the heat exchanger, with raised portions only located near the fittings. Although the heat exchanger 10 has been illustrated as being rectangular, it could also have different shapes—for example it could have a square or trapezoidal shapes in some applications.

Figure 9:
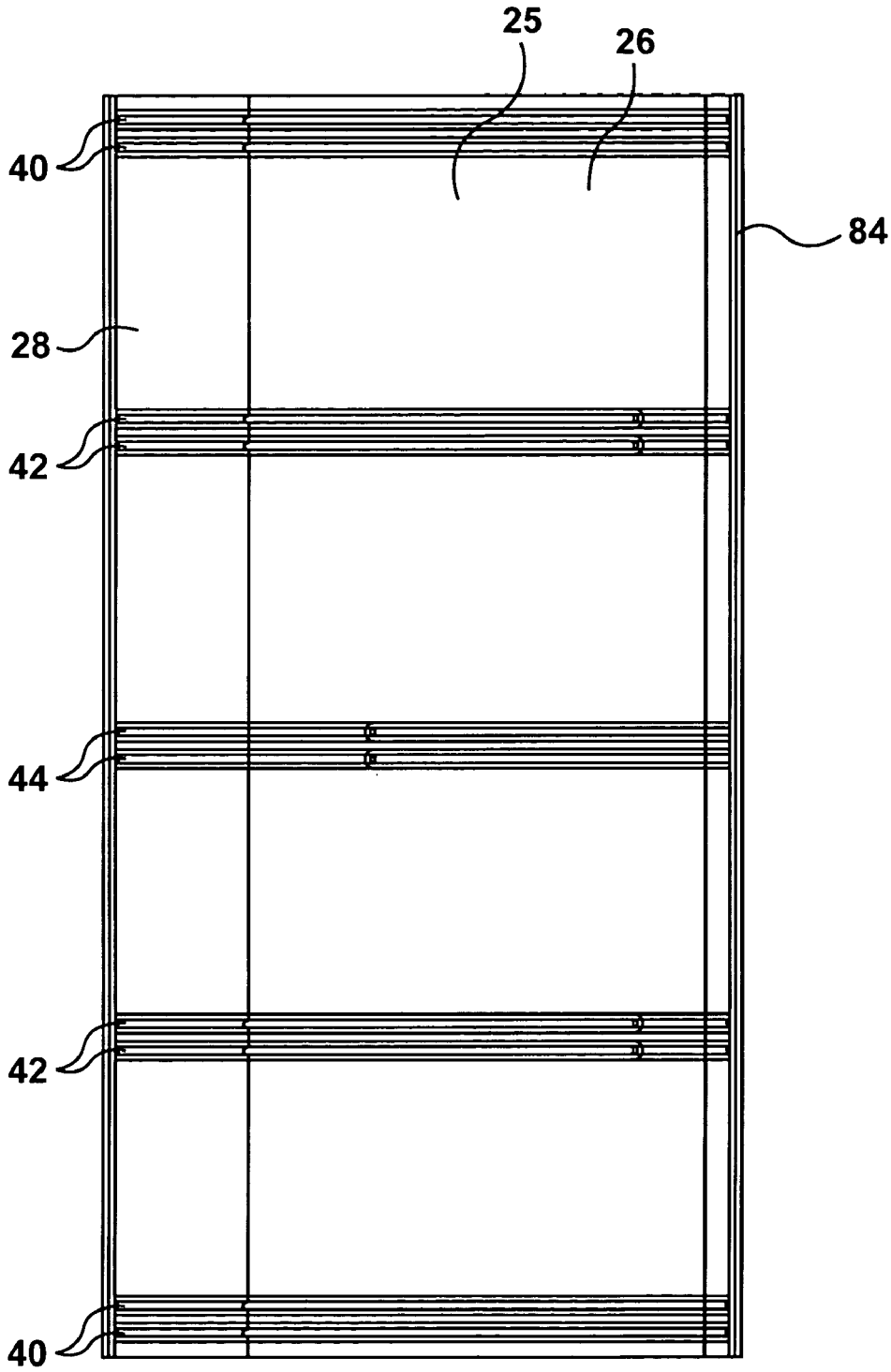
FIG. 9 is a top plan view of an alternative cover plate that can be used with the heat exchanger of FIG. 1.

FIG. 9 shows an alternative cover plate 84 that can be used with the heat exchanger 10. The cover plate 84 is identical to cover plate 16, with the one difference that all of the sets of parallel ribs 40, 42 and 44 are identical to each other and extend the entire width of the cover plate 84 regardless of the width of their corresponding end and baffle plates. Such a configuration allows identical tooling to be used for each of the rib sets, further enhancing the manufacturability of the heat exchanger in different sizes and configurations.

Figure 10:
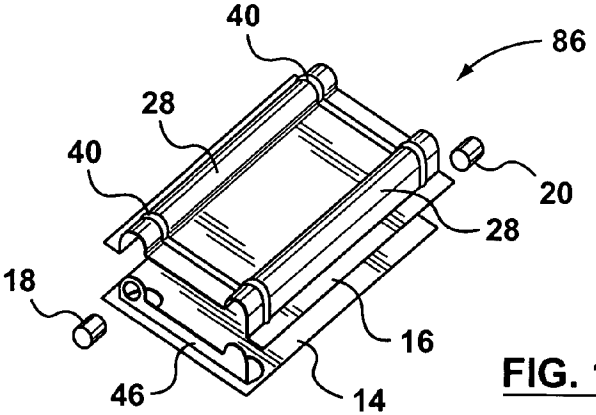
FIG. 10 is a simplified exploded perspective view of a further embodiment of a heat exchanger in accordance with the present invention.

Inlet and outlet fittings 18, 20 may, in some embodiments, be positioned at locations other than directly opposite each other. For example, FIG. 10 shows a diagrammatic exploded view of a heat exchanger 86 according to another embodiment of the invention. Heat exchanger 86 is substantially identical to heat exchanger 10, except that the inlet and outlet fittings 18 and 20 are diagonally located rather than longitudinally opposite, and the cover plate 16 includes two spaced apart semi-cylindrical manifold portions 28 rather than just one. (Fin plate 12 is not shown in FIG. 10).

Figure 12:
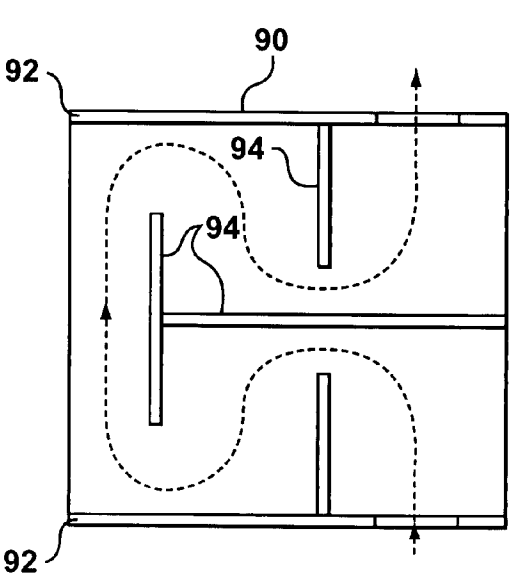
FIGS. 11 and 12 are top plan views of alternative shim plate configurations for use in heat exchangers of the present invention.
Figure 11:
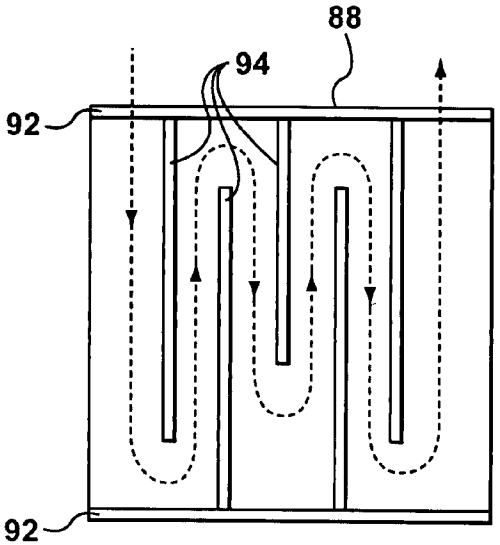

It will be appreciated that different baffle configurations could be used to provide flow circuiting through fluid passage 22. By way of example only, FIGS. 11 and 12 show two alternative shim plate configurations (cut lines are not shown in FIGS. 11 and 12) showing different end wall 92 and baffle wall 94 configurations to provide the flow paths shown in such Figures In some embodiments, there may be no baffle walls.

A variety of different types of turbulizers or flow augmentation means can be used in the fluid passage 22, and in some applications, the turbulizer 72 may not be present.

As will be apparent to those skilled in the art, many alterations and modifications are possible in the practice of this invention without departing from the spirit or scope thereof. Accordingly, the scope of the invention is to be construed in accordance with the substance defined by the following claims.

What is claimed is:

1. A surface cooled heat exchanger including:

a substantially planar shim plate with spaced apart integral first and second end walls extending laterally therefrom;

a separately formed cover plate having a central wall with integral first and second side walls extending from opposite sides of the central wall;

the first and second side walls of the cover plate being sealably joined to respective side edges of the shim plate, the first and second end walls being sealably joined to respective ends of the cover plate, the central wall and shim plate being spaced apart with an internal fluid passage being defined therebetween with inlet and outlet openings provided in flow communication with the fluid passage to allow fluid to flow into, through, and out of the fluid passage; and a support wall with a first side abutting against and secured to the shim plate and an opposite facing exposed second side, wherein the end walls are each formed from portions that have been partially cut from the planar shim plate and folded about a fold line to extend substantially perpendicular to the shim plate.

2. The heat exchanger of claim 1 wherein two parallel ribs projecting towards the shim plate are formed across each of the ends of the cover plate for engaging therebetween a peripheral edge of the respective end walls.

3. The heat exchanger of claim 1 wherein the shim plate and cover plate are brazed to each other.

4. The heat exchanger of claim 1 wherein a rib projecting towards the shim plate is formed across each of the ends of the cover plate for engaging a peripheral edge of the respective end walls.

5. The heat exchanger of claim 1 wherein a plurality of exposed cooling fins are provided on the second side.

6. The heat exchanger of claim 3 wherein two parallel ribs projecting towards the shim plate are formed across each of the ends of the cover plate for engaging therebetween a peripheral edge of the respective end walls.

7. The heat exchanger of claim 1 wherein at least one flow circuiting baffle wall is provided in the fluid passage, the baffle wall being formed from a portion that has been partially cut from the planar shim plate and folded about a fold line to extend from the shim plate with a peripheral edge at least partially in engagement with an inner surface of the cover plate.

8. The heat exchanger of claim 7 wherein two parallel ribs are formed across the cover plate for engaging therebetween the peripheral edge of the at least one flow circuiting baffle wall.

9. The heat exchanger of claim 1 wherein a flow circuiting baffle wall extends laterally from the shim plate to partially block the fluid passage, the baffle wall and first and second end walls each being parallel to each other, the cover plate having formed thereon identical spaced apart sets of two parallel ribs, each set of two parallel ribs engaging there between an edge of a respective one of the first end wall, second end wall, and baffle wall.

10. The heat exchanger of claim 1 including a turbulizer in the fluid passage.

11. The heat exchanger of claim 1 wherein the first end wall is substantially planar and the inlet opening is provided therethrough, including an inlet fitting secured to the first end wall in flow communication with the fluid passage.

12. The heat exchanger of claim 11 wherein the second end wall is substantially planar and the outlet opening is provided therethrough, including an outlet fitting secured to the second end wall in flow communication with the fluid passage.

13. The heat exchanger of claim 12 wherein the inlet opening and the outlet opening are located longitudinally opposite each other.

14. The heat exchanger of claim 13 wherein the central wall of the cover plate includes an outwardly extending manifold portion and a planar portion that extend between ends of the cover plate, the manifold portion being spaced further from the shim plate than the planar portion to define an enlarged manifold passage portion in the fluid passage, the inlet and outlet openings being located to communicate directly with the manifold passage.

15. The heat exchanger of claim 12 wherein the central wall of the cover plate includes spaced-apart first and second outwardly extending manifold portions and a planar portion therebetween, the manifold portions each being spaced further from the shim plate than the planar portion to define first and second enlarged manifold passage portions in the fluid passage, the inlet opening being located to communicate directly with the first manifold passage and the outlet opening being located to communicate directly with the second manifold passage.

16. The heat exchanger of claim 1 wherein the central wall of the cover plate includes a outwardly extending manifold portion and a planar portion, the manifold portion being spaced further from the shim plate than the planar portion.

17. The heat exchanger of claim 1 wherein an integral planar lateral flange is provided along the peripheral edge of each of the side walls, the planar lateral flanges being brazed to the shim plate.

18. A surface cooled heat exchanger including a substantially planar shim plate and a separately formed cover plate sealably joined about peripheral edges thereof and defining an internal fluid passage having inlet and outlet openings; and a flow circuiting baffle wall in the fluid passage, connected to and extending from the shim plate towards the cover plate, the cover plate having a first rib formed thereon extending towards the shim plate and engaging an extending peripheral edge of the baffle wall, and including a support wall with a first side abutting against and secured to the shim plate and an opposite facing exposed second side, the baffle wall being formed from a portion that has been partially cut from the planar shim plate and folded about a fold line to extend from the shim plate.

19. The heat exchanger of claim 18 wherein the cover plate includes a second rib parallel to the first rib, the peripheral edge of the baffle wall being engaged between the first and second rib.

* * * * *